US007293320B2

(12) United States Patent
Van Norden

(10) Patent No.: US 7,293,320 B2
(45) Date of Patent: Nov. 13, 2007

(54) VACUUM ATTACHMENT FOR CONVERTING A STANDARD VACUUM INTO A CENTRALIZED DUST COLLECTION SYSTEM

(76) Inventor: Byron T. Van Norden, 3241 Highway 14 East, Newton, IA (US) 50208

( * ) Notice: Subject to any disclaimer, the term of this patent is extended or adjusted under 35 U.S.C. 154(b) by 539 days.

(21) Appl. No.: 10/928,500

(22) Filed: Aug. 27, 2004

(65) Prior Publication Data

US 2006/0042037 A1 Mar. 2, 2006

(51) Int. Cl.
*A47L 5/36* (2006.01)

(52) U.S. Cl. ..... 15/246.2; 15/328; 15/314; 15/339

(58) Field of Classification Search ..... 15/246.2, 15/314, 328, 339, 331, 301; *A47L 5/36*
See application file for complete search history.

(56) References Cited

U.S. PATENT DOCUMENTS 3,483,503 A * 12/1969 Paradiso ..... 15/314
4,174,858 A * 11/1979 Brooks ..... 285/7
4,683,608 A 8/1987 Berfield et al.
4,977,638 A * 12/1990 Best ..... 15/301
5,099,544 A * 3/1992 Yamamoto ..... 15/314
5,551,117 A 9/1996 Bamman
5,606,767 A * 3/1997 Crlenjak et al. ..... 15/301
5,943,732 A 8/1999 Bosyj et al.
5,983,446 A 11/1999 Hsia
6,108,863 A 8/2000 Lin
6,193,461 B1 2/2001 Hablanian

* cited by examiner

*Primary Examiner*—Theresa T. Snider
(74) *Attorney, Agent, or Firm*—Dale J. Ream

(57) ABSTRACT

A vacuum attachment includes an aerodynamic bell housing, a distribution plate defining blast gate openings, blast gates, and means for biasing each gate toward a closed configuration. The plate attaches to the housing's first end. The gates attach to the plate for selectively covering the gate openings. An outer face of each gate includes an indented configuration. Gate openings may include internal threads. A filter may be positioned in the housing. The housing attaches to the vacuum's inlet port. Vacuum lines are inserted in the gate openings, moving the gates from closed to open configurations. The lines are locked into place by the gates' configurations and biasing means, and attached lines operate concurrently. Size and arrangement of the gate openings maintain the vacuum's airflow velocity and optimal flow patterns. To remove a line, it is withdrawn from the respective gate opening. The biasing means then automatically closes the corresponding gate.

16 Claims, 6 Drawing Sheets

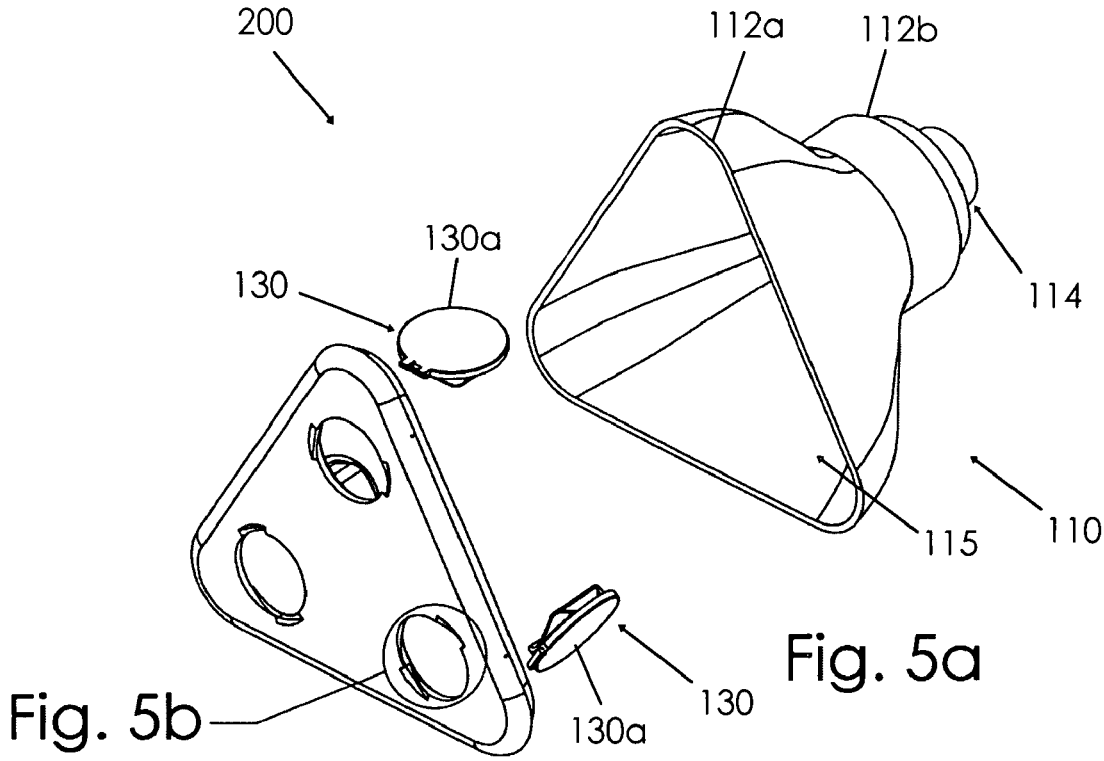
Fig. 5a
Fig. 5b
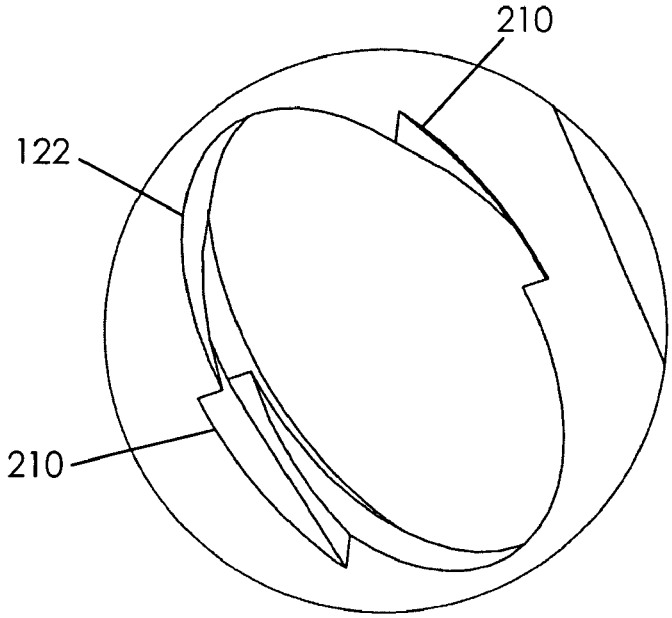
Fig. 5b

VACUUM ATTACHMENT FOR CONVERTING A STANDARD VACUUM INTO A CENTRALIZED DUST COLLECTION SYSTEM

BACKGROUND OF THE INVENTION

This invention relates generally to a dust collection device. In particular, the present invention relates to a vacuum attachment that allows multiple tools to utilize a single vacuum source, effectively converting a standard vacuum into a centralized dust collection system.

Dust collection has made construction and building-related fields much healthier in recent years. However, this collection often becomes expensive and cumbersome due to the multiple vacuums currently being used at each single location. Indeed, power tools currently utilize independent dust collection systems that are large and heavy. Reducing the current bulk would allow more space for other tools and equipment as well as produce cost savings.

Various devices have been proposed for altering the traditional vacuum design. Although assumably effective for their intended purposes, the existing devices do not provide a device that allows a single standard vacuum to operate multiple vacuum lines either concurrently or at different times, allows multiple vacuum lines to be easily interchanged, securely attaches to vacuum lines, and automatically compensates for any vacuum lines that are not attached to the device. Therefore, it would be desirable to have a vacuum attachment having these features.

SUMMARY OF THE INVENTION

A vacuum attachment according to the present invention includes an aerodynamic bell housing, a distribution plate defining a plurality of blast gate openings, a plurality of blast gates, and means for biasing each blast gate toward a closed configuration. The bell housing has a first end defining an opening and a second end defining a bell housing outlet. The distribution plate is attached to the first end of the bell housing. The blast gates are hingedly attached to the distribution plate for selectively covering the blast gate openings, and an outer face of each blast gate includes an indented configuration. At least one blast gate opening may include an internal thread, and a coarse filter may be positioned in the bell housing.

In use, the vacuum attachment converts a standard vacuum cleaner having an inlet port into a centralized dust collection system. The bell housing is first attached to the vacuum's inlet port. One or more vacuum lines are inserted in the blast gate openings, forcing the blast gates to move from closed to open configurations. The vacuum lines are locked into place by a combination of the blast gates' configurations and the blast gates' biasing means, and the attached vacuum lines may then be used concurrently. The size and arrangement of the blast gate openings maintain the airflow velocity created by the vacuum and optimal flow patterns. If a vacuum line is no longer needed, it is simply withdrawn from the respective blast gate opening. The corresponding blast gate then automatically moves from the open configuration to the closed configuration due to the biasing means.

Therefore, a general object of this invention is to provide a vacuum attachment that allows a single standard vacuum to operate multiple vacuum lines either concurrently or at different times.

Another object of this invention is to provide a vacuum attachment, as aforesaid, that allows multiple vacuum lines to be easily interchanged.

Still another object of this invention is to provide a vacuum attachment, as aforesaid, that securely attaches to vacuum lines.

Yet another object of this invention is to provide a vacuum attachment, as aforesaid, that automatically compensates for any vacuum lines that are not attached to the device.

A further object of this invention is to provide a vacuum attachment, as aforesaid, that is easily and economically manufactured.

A still further object of this invention is to provide a vacuum attachment, as aforesaid, that prevents large debris from entering the attached vacuum.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 5*a* is an exploded view of a vacuum attachment according to another embodiment of the present invention;

FIG. 5*b* is a perspective view on an enlarged scale of a blast gate opening that includes an internal thread as in FIG. 5*a*.

DESCRIPTION OF THE PREFERRED EMBODIMENT

Figure 1:
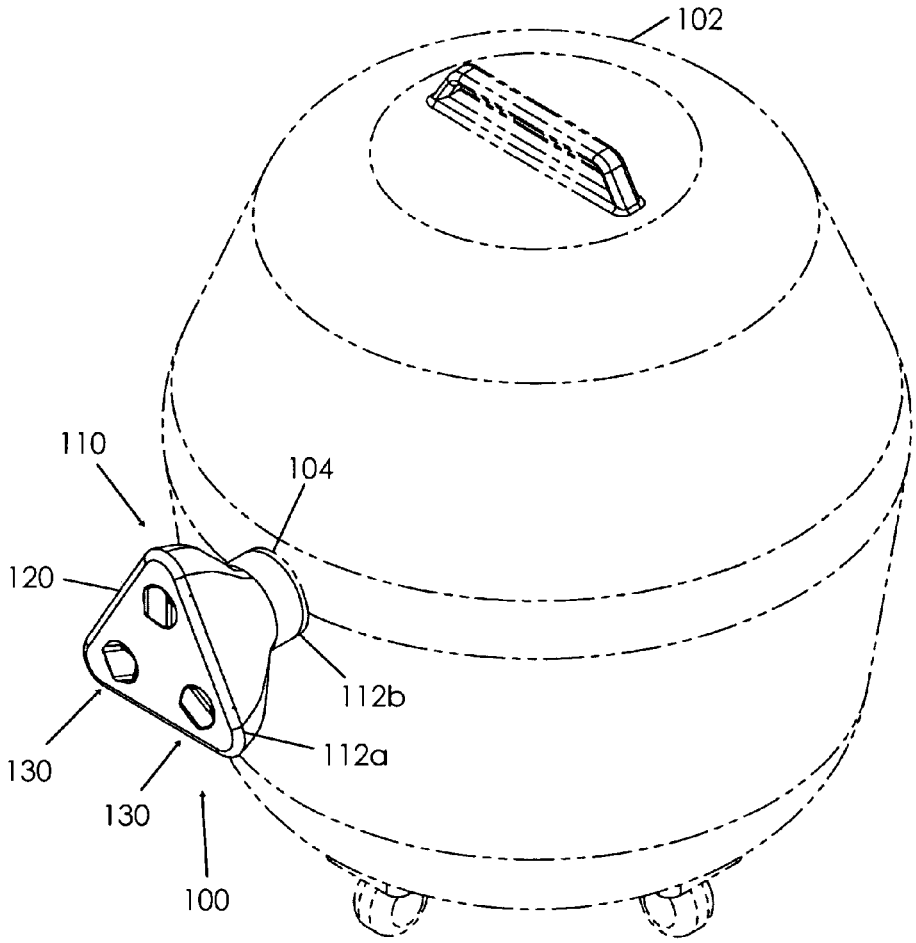
FIG. 1 is a perspective view of vacuum attachment according to the present invention positioned on a vacuum (shown in phantom lines)
Figure 2:
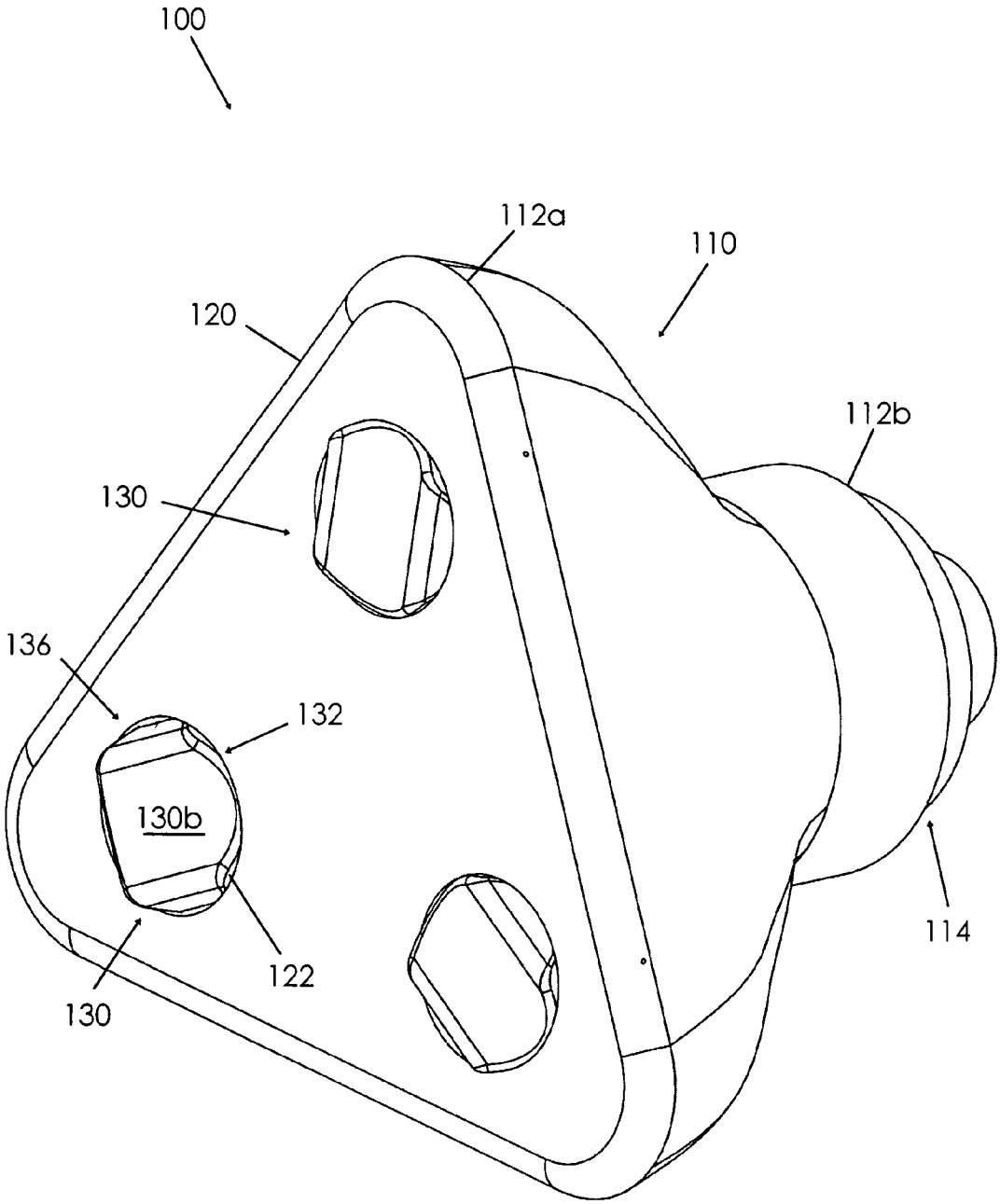
FIG. 2 is an enlarged perspective view of the vacuum attachment as in FIG. 1.

A vacuum attachment for use with a standard vacuum cleaner having an inlet port according to the present invention will now be described in detail with reference to FIGS. 1 through 4*c* of the accompanying drawings. More particularly, a vacuum attachment 100 includes an aerodynamic bell housing 110, a distribution plate 120 defining a plurality of blast gate openings 122, a plurality of blast gates 130, and means 140 for biasing each blast gate 130 toward a closed configuration 136 (FIGS. 2 and 4*b*).

The aerodynamic bell housing 110 has first and second ends 112*a*, 112*b*. The first end 112*a* of the bell housing 110 defines an opening 115 (FIG. 5*a*). The second end 112*b* of the bell housing 110 defines a bell housing outlet 113 and includes a standard configuration 114 (also called standard coupling means 114) for releasably coupling the bell housing 110 to an inlet port 104 of a standard vacuum cleaner 102 (FIGS. 4*b* and 4*c*). The bell housing 110 is preferably constructed of injection molded plastic, but it may be constructed of another suitable material.

The distribution plate 120 is attached to the first end 112*a* of the bell housing 110 and defines a plurality of blast gate openings 122. The distribution plate 120 may be either removably or fixedly attached to the bell housing 110. Each blast gate opening 122 has a predetermined cross-sectional area 122*a* and a centerpoint 122*b* (FIG. 4*a*), and the bell housing outlet 113 has a predetermined cross-sectional area 113*a* and a centerpoint 113*b* (FIG. 4*c*). To maintain the airflow velocity created by the vacuum 102, the sum of the cross-sectional areas 122*a* of all blast gate openings 122 should be less than the cross-sectional area 113*a* of the bell housing outlet 113. To maintain optimal flow patterns, each centerpoint 122*b* of the blast gate openings 122 should be substantially equidistant to the centerpoint 113*b* of the bell housing outlet 113, and the centerpoints 122*b* of the blast gate openings 122 should be spaced substantially equally apart.

Figure 4A:
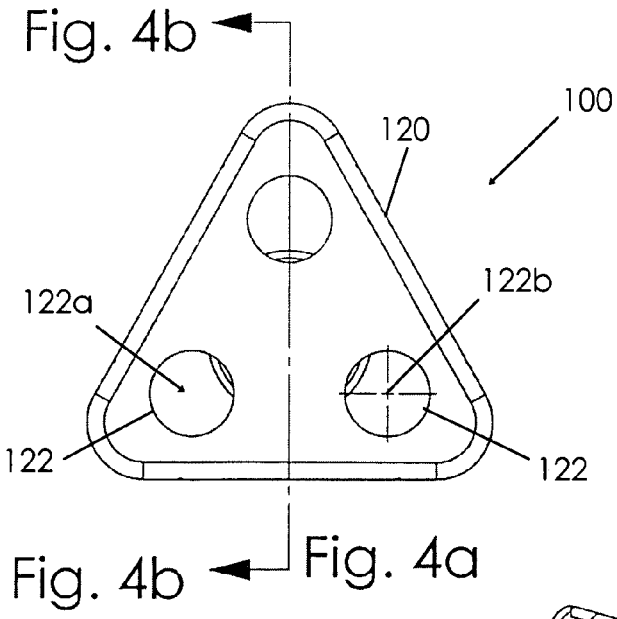
FIG. 4*a* is a front view of the vacuum attachment as in FIG. 1 with the blast gates in an open configuration.
Figure 4B:
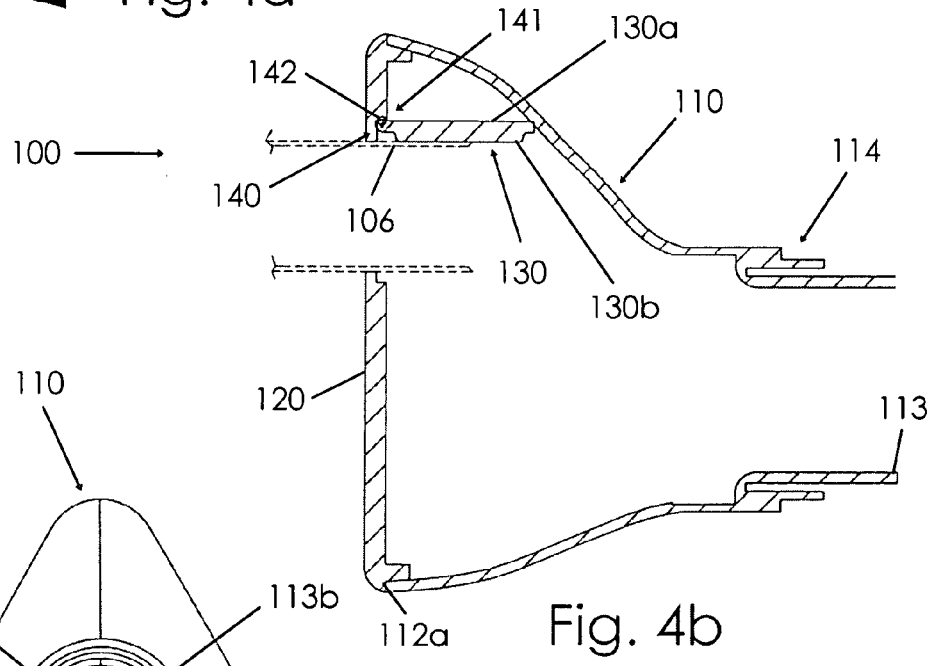
FIG. 4*b* is a sectional view taken along line 4*b*-4*b* in FIG. 4*a* with a vacuum line (shown in phantom lines)
Figure 4C:
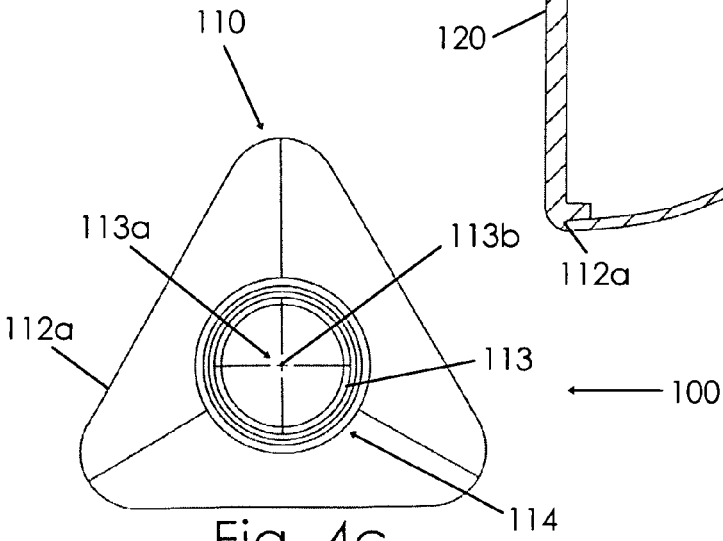
FIG. 4*c* is a rear view of the vacuum attachment as in FIG. 1.

The plurality of blast gates 130 corresponds to the plurality of blast gate openings 122, and each blast gate 130 is hingedly attached to the distribution plate 120 proximate a respective blast gate opening 122 for selectively covering the respective blast gate opening 122 (FIG. 4*b*). Each blast gate 130 has an inner face 130*a* (FIGS. 4*b* and 5*a*) and an outer face 130*b* (FIGS. 2 and 4*b*), and each outer face 130*b* of each blast gate 130 includes an indented configuration 132 (FIG. 2) complementary to a configuration of a vacuum line 106 of the vacuum 102. Due to the indented configurations 132, a respective blast gate 130 and a vacuum line 106 adjoin substantially flush when the vacuum line 106 is inserted in the respective blast gate opening 122 and the respective blast gate 130 is in an open configuration 138.

The means 140 for biasing each blast gate 130 toward the closed configuration 136 includes a spring 142 incorporated in each hinged attachment 141 of a respective blast gate 130 to the distribution plate 120 (FIG. 4*b*).

Figure 3A:
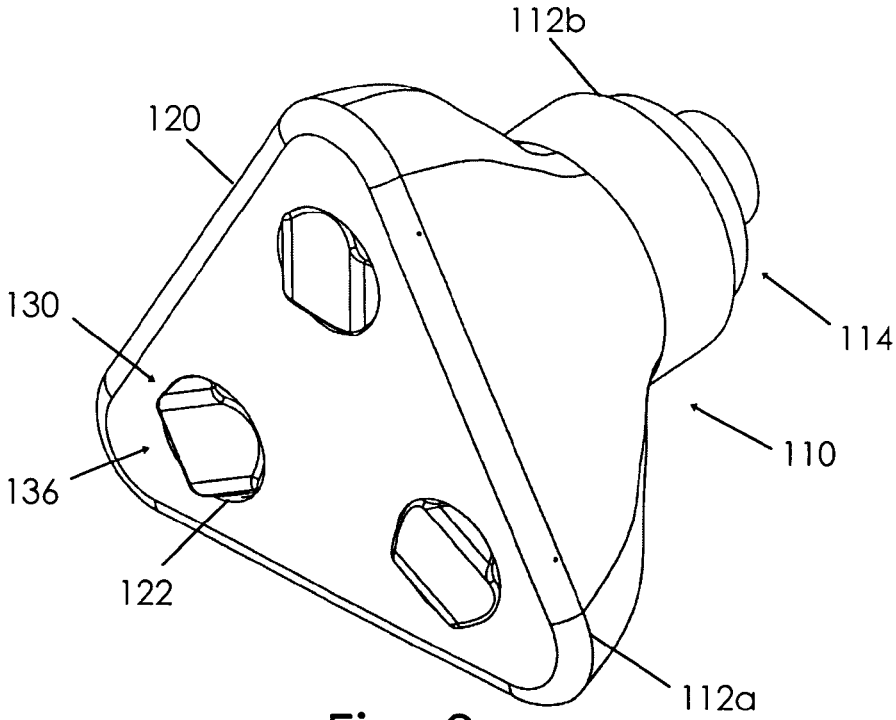
FIG. 3*a* is a perspective view of the vacuum attachment as in FIG. 1 with the blast gates in a closed configuration.
Figure 3B:
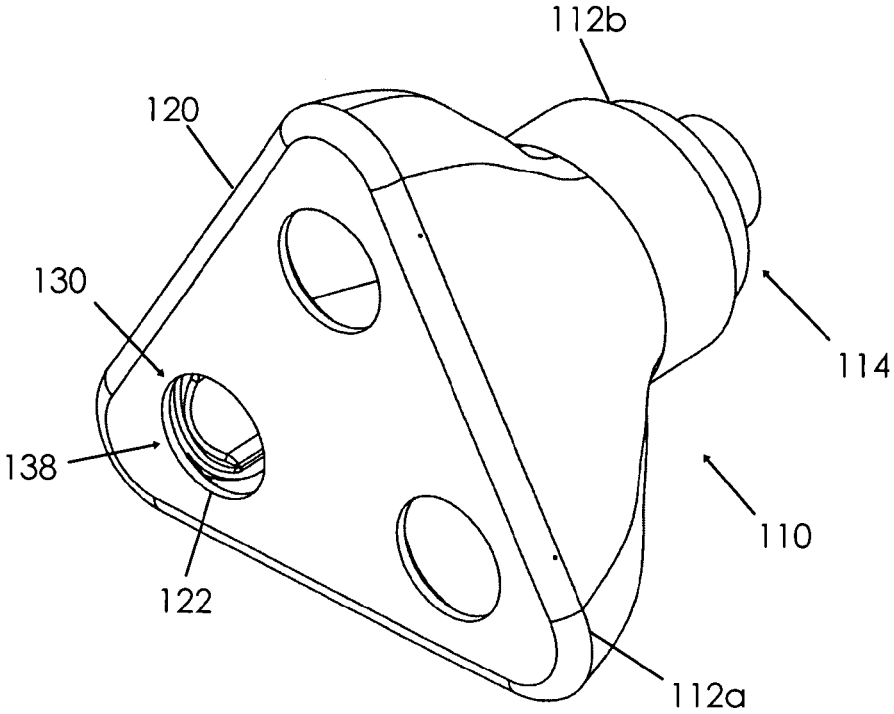
FIG. 3*b* is a perspective view of the vacuum attachment as in FIG. 1 with the blast gates in an open configuration.

In use, the vacuum attachment 100 is used for converting a standard vacuum cleaner 102 having an inlet port 104 into a centralized dust collection system. The standard coupling means 114 of the second end 112*b* of the bell housing 110 attach the bell housing 110 to the inlet port 104 of the vacuum 102. All blast gates 130 are initially in the closed configurations 136 (FIG. 3*a*) due to the biasing means 140 in the hinged attachments 141. One or more vacuum lines 106 may be inserted in the blast gate openings 122, forcing the respective blast gates 130 to move to open configurations 138 (FIG. 3*b*).

Once a respective blast gate 130 is in the open configuration 138 and a vacuum line 106 is fully inserted in the respective blast gate opening 122, the respective blast gate 130 and vacuum line 106 adjoin substantially flush (FIG. 4*b*). This substantially flush connection allows the blast gate 130 and biasing means 140 to act as an effective locking mechanism, as the blast gate 130 transfers a force from the biasing means 140 to the vacuum line 106 in a direction that is normal to the direction in which the vacuum line 106 was inserted in the blast gate opening 122. If the blast gate 130 did not include the indented configuration 132, the transferred force would be concentrated along a single line of contact, making the locking effect less stable and effective.

When the vacuum 102 is activated, air is drawn from the attached vacuum lines 106 through the vacuum attachment 100 and the inlet port 104 of the vacuum 102. The size and arrangement of the blast gate openings 122 as described above maintain the airflow velocity created by the vacuum 102 and optimal flow patterns.

If a vacuum line 106 is no longer necessary, it is simply withdrawn from the respective blast gate opening 122. The corresponding blast gate 130 then automatically moves from the open configuration 138 (FIG. 3*b*) to the closed configuration 136 (FIG. 3*a*) due to the biasing means 140.

A vacuum attachment 200 according to another embodiment of the present invention is shown in FIGS. 5*a* and 5*b* and includes a construction substantially similar to the construction previously described except as specifically noted below. More particularly, at least one blast gate opening 122 according to this embodiment includes an internal thread 210 for releasably connecting a vacuum line with a compatible external thread (not shown) to the bell housing 110. This thread arrangement helps secure the connection between the vacuum line 106 and the bell housing 110.

Figure 6:
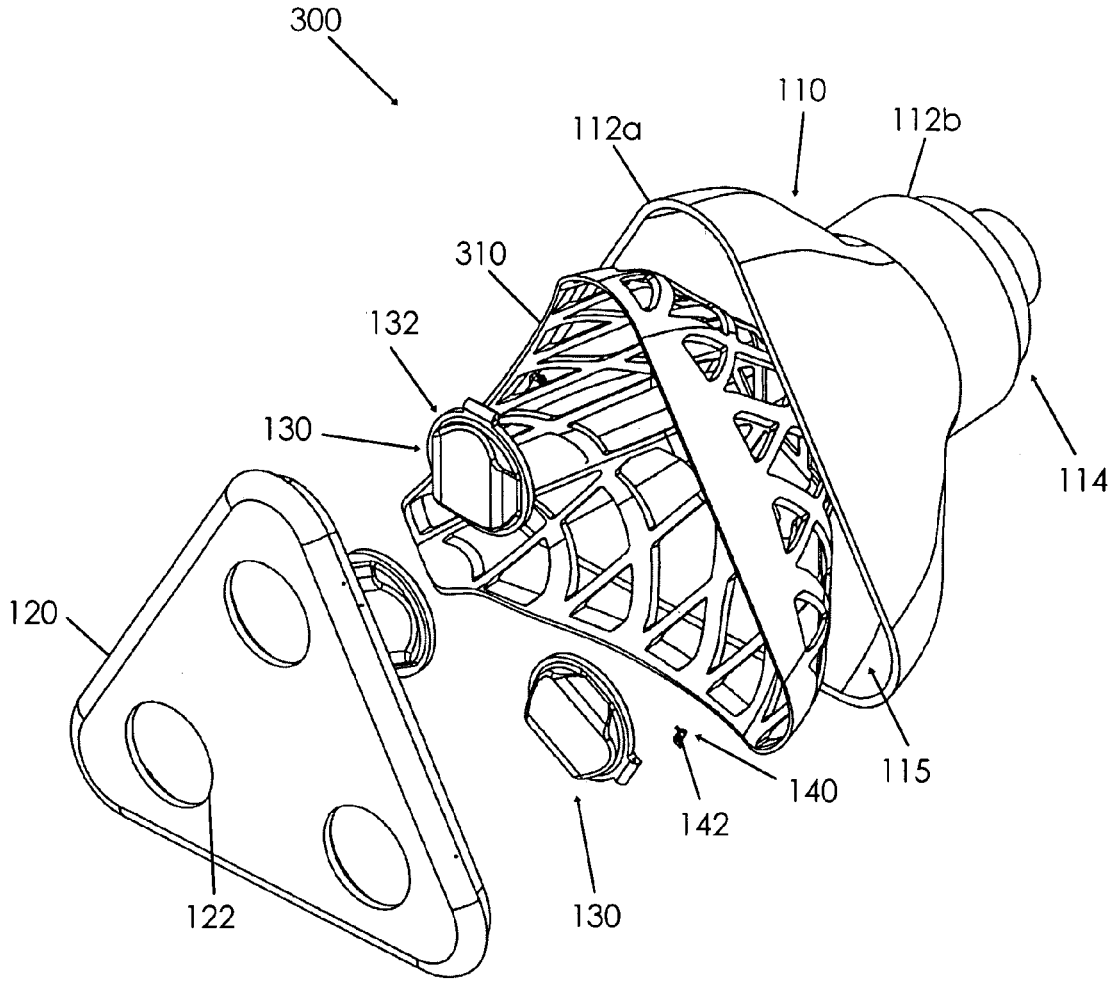
FIG. 6 is an exploded view of a vacuum attachment according to still another embodiment of the present invention.

A vacuum attachment 300 according to still another embodiment of the present invention is shown in FIG. 6 and includes a construction substantially similar to the construction previously described except as specifically noted below. More particularly, the vacuum attachment 300 according to this embodiment includes a filter 310. The filter 310 is preferably a coarse filter 310 and is positioned inside the bell housing 110 for preventing debris larger than a predetermined size from entering the vacuum 102. Though the filter 310 is preferably disposable, it is of course possible for the filter 310 to be reusable.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A vaccum attachment for use with a standard vacuum cleaner having an inlet port, comprising:

an aerodynamic bell housing having first and second ends, said second end including means for releasably coupling said bell housing to the inlet port of the vacuum cleaner;

a distribution plate attached to said first end of said bell housing, said distribution plate defining a plurality of blast gate openings;

a plurality of blast gates corresponding to said plurality of blast gate openings, each said blast gate being hingedly attached to said distribution plate proximate a respective blast gate opening for selectively covering said respective blast gate opening;

wherein each said blast gate has an inner face and an outer face; and wherein each said outer face includes an indented configuration complementary to a configuration of a vacuum line, whereby a respective blast gate and said vacuum line adjoin substantially flush when said vacuum line is inserted in a respective blast gate opening and said respective blast gate is in an open configuration.

2. The vacuum attachment as in claim 1, wherein each said hinged attachment of a respective blast gate to said distribution plate includes a spring for biasing said blast gate toward a closed configuration.

3. The vacuum attachment as in claim 2, wherein at least one said blast gate opening includes an internal thread for releasably connecting a vacuum line to said bell housing.

4. The vacuum attachment as in claim 1, wherein at least one said blast gate opening includes an internal thread for securely connecting a vacuum line to said bell housing.

5. The vacuum attachment as in claim 1, wherein each said blast gate opening includes an internal thread for securely connecting a vacuum line to said bell housing.

6. The vacuum attachment as in claim 1, further comprising a coarse filter positioned inside said bell housing for preventing debris larger than a predetermined size from entering said vacuum cleaner.

7. The vacuum attachment as in claim 6 wherein said distribution plate is removably attached to said first end of said bell housing.

8. The vacuum attachment as in claim 6, wherein said filter is a disposable filter.

9. The vacuum attachment as in claim 1, wherein said bell housing is constructed of injection molded plastic.

10. A vacuum attachment for use with a standard vacuum cleaner having an inlet port, comprising:

an aerodynamic bell housing having first and second ends, said second end including means for releasably coupling said bell housing to the inlet port of the vacuum cleaner, said second end defining a bell housing outlet having a predetermined cross-sectional area;

a distribution plate attached to said first end of said bell housing, said distribution plate defining a plurality of blast gate openings, each said blast gate opening having a predetermined cross-sectional area;

a plurality of blast gates corresponding to said plurality of blast gate openings, each said blast gate being hingedly attached to said distribution plate proximate a respective blast gate opening for selectively covering said respective blast gate opening;

means for biasing each said blast gate toward a closed configuration;

wherein a sum of said cross-sectional areas of all said blast gate openings is less than said cross-sectional area of said bell housing outlet;

wherein each said blast gate has an inner face and an outer face; and wherein each said outer face includes an indented configuration complementary to a configuration of a vacuum line, whereby a respective blast gate and said vacuum line adjoin substantially flush when said vacuum line is inserted in a respective blast gate opening and said respective blast gate is in an open configuration.

11. The vacuum attachment as in claim 10, wherein said biasing means includes a spring.

12. The vacuum attachment as in claim 11, wherein at least one said blast gate opening includes an internal thread for releasably connecting a vacuum line to said bell housing.

13. The vacuum attachment as in claim 12, wherein said distribution plate is removably attached to said first end of said bell housing, further comprising a coarse filter positioned inside said bell housing for preventing debris larger than a predetermined size from entering said vacuum cleaner.

14. The vacuum attachment as in claim 10, wherein said distribution plate is removably attached to said first end of said bell housing, further comprising a coarse filter positioned inside said bell housing for preventing debris larger than a predetermined size from entering said vacuum cleaner.

15. The vacuum attachment as in claim 10, wherein:

each said blast gate opening has a centerpoint;

said bell housing outlet has a centerpoint; and each said centerpoint of said blast gate openings is substantially equidistant to said centerpoint of said bell housing outlet.

16. The vacuum attachment as in claim 15, wherein said centerpoints of said blast gate openings are spaced substantially equally apart.

* * * * *